US009877529B2

(12) United States Patent
Andrews et al.

(10) Patent No.: US 9,877,529 B2
(45) **Date of Patent: *Jan. 30, 2018**

(54) PROTECTIVE GLOVE WITH ENHANCED EXTERIOR SECTIONS

(71) Applicant: World Fibers, Inc., Concord, NC (US)

(72) Inventors: Gregory V. Andrews, Concord, NC (US); Rayvon A. Morton, Oakboro, NC (US); Paul W. Cornelison, Salisbury, NC (US); John D. Simmons, Rockwell, NC (US)

(73) Assignee: World Fibers, Inc., Concord, NC (US)

( * ) Notice: Subject to any disclaimer, the term of this patent is extended or adjusted under 35 U.S.C. 154(b) by 769 days.

This patent is subject to a terminal disclaimer.

(21) Appl. No.: 14/296,612

(22) Filed: Jun. 5, 2014

(65) Prior Publication Data

US 2014/0283559 A1 Sep. 25, 2014

Related U.S. Application Data

(63) Continuation-in-part of application No. 14/210,533, filed on Mar. 14, 2014.

(Continued)

(51) Int. Cl.

| | |
|---|---|
| ***A41D 19/00*** | (2006.01) |
| ***A41D 19/015*** | (2006.01) |
| ***D02G 3/44*** | (2006.01) |

(52) U.S. Cl.

CPC ... *A41D 19/01505* (2013.01); *A41D 19/0006* (2013.01); *D02G 3/442* (2013.01); *A41D 2500/10* (2013.01)

(58) Field of Classification Search

CPC ..... A41D 19/01505; A41D 19/006; A41D 2500/10; D02G 3/442

(Continued)

(56) References Cited

U.S. PATENT DOCUMENTS 4,384,449 A * 5/1983 Byrnes, Sr. ..... A41D 19/01511 139/425 R
4,470,251 A * 9/1984 Bettcher ..... A41D 19/01511 2/16

(Continued)

FOREIGN PATENT DOCUMENTS

EP 118898 A2 9/1984
EP 2468121 A1 6/2012

(Continued)

OTHER PUBLICATIONS

International Search Report for International Application No. PCT/US2015/032839, dated Oct. 15, 2015.

(Continued)

*Primary Examiner* — Alissa L Hoey
(74) *Attorney, Agent, or Firm* — Ashley Law Firm P.C.; Stephen S. Ashley, Jr.

(57) ABSTRACT

A protective glove includes a primary yarn that forms the palm, thumb and finger sections of the glove. The primary yarn has an interior surface forming the interior surface of the glove, and an exterior surface forming the exterior surface of the glove. A plaiting yarn is plaited to portions of the exterior surface of the primary yarn to form a plurality of enhanced sections on the exterior surface of the glove. The enhanced sections having at least one substantially enhanced physical characteristic in relation to the primary layer, such as increased cut resistance.

6 Claims, 10 Drawing Sheets

Related U.S. Application Data

(60) Provisional application No. 61/789,990, filed on Mar. 15, 2013.

(58) Field of Classification Search
USPC ..... 2/167
See application file for complete search history.

(56) References Cited

U.S. PATENT DOCUMENTS 4,651,514 A * 3/1987 Collett ..... A41D 31/0055 2/167
4,777,789 A * 10/1988 Kolmes ..... D02G 3/12 2/167
4,825,470 A * 5/1989 Horio ..... A41D 13/087 2/161.8
4,838,017 A * 6/1989 Kolmes ..... D02G 3/12 2/167
4,912,781 A * 4/1990 Robins ..... A41D 19/01511 2/16
5,248,548 A * 9/1993 Toon ..... A41D 19/01511 2/167
5,442,815 A 8/1995 Cordova et al.
5,628,172 A * 5/1997 Kolmes ..... D02G 3/442 2/167
5,965,223 A 10/1999 Andrews et al.
6,033,779 A * 3/2000 Andrews ..... A41D 19/01511 428/222
6,155,084 A 12/2000 Andrews et al.
6,161,400 A * 12/2000 Hummel ..... A41D 19/01505 2/16
6,216,431 B1 4/2001 Andrews
6,279,305 B1 8/2001 Hummel
6,581,212 B1 6/2003 Andresen
6,581,366 B1 6/2003 Andrews
6,766,635 B2 7/2004 Andrews
6,779,330 B1 8/2004 Andrews et al.
6,782,720 B2 8/2004 Vero et al.
6,803,332 B2 10/2004 Andrews
6,823,699 B1 * 11/2004 Vero ..... A41D 19/01505 2/161.6
7,121,077 B2 10/2006 Andrews et al.
7,434,422 B2 10/2008 Thompson et al.
7,555,921 B2 7/2009 Thompson et al.
8,074,436 B2 12/2011 Hardee et al.
8,239,969 B2 8/2012 Fisher
2005/0204449 A1 * 9/2005 Baron ..... A41D 1/04 2/69
2008/0289312 A1 * 11/2008 Takada ..... A41D 19/01511 57/232
2010/0024095 A1 * 2/2010 Gellis ..... A41D 19/0065 2/161.8
2010/0050699 A1 * 3/2010 Kolmes ..... A41B 9/00 66/174
2010/0095428 A1 4/2010 Fisher
2010/0275341 A1 11/2010 Sweeney et al.
2010/0275342 A1 * 11/2010 Sweeney ..... A41D 19/01505 2/167
2010/0325777 A1 * 12/2010 Radhakrishnan A41D 19/01558 2/161.1
2011/0209505 A1 * 9/2011 Thompson ..... A41D 19/01547 66/174
2011/0265245 A1 11/2011 Asiaghi
2012/0204604 A1 8/2012 Azeem et al.
2013/0000005 A1 * 1/2013 Hughes ..... A41D 19/01505 2/16
2013/0180027 A1 * 7/2013 Rock ..... A41D 19/01505 2/167
2013/0205469 A1 * 8/2013 Thompson ..... A41D 19/015 2/163
2013/0213094 A1 8/2013 Moreland et al.
2014/0090349 A1 * 4/2014 Fisher ..... D02G 3/367 57/222
2014/0237701 A1 * 8/2014 Thompson ..... A41D 19/001 2/164
2014/0259285 A1 * 9/2014 Andrews ..... A41D 19/01505 2/167
2015/0181956 A1 * 7/2015 Andrews ..... A41D 19/01547 2/167
2016/0073713 A1 * 3/2016 Takata ..... A41D 19/01505 2/167

FOREIGN PATENT DOCUMENTS

RU 55256 U1 10/2006
SU 1369661 A3 1/1988
WO WO2000015063 A1 3/2000
WO WO00/65941 A1 11/2000
WO WO2007024872 A2 3/2001
WO WO 2013156790 A1 * 10/2013 ..... D04B 1/28

OTHER PUBLICATIONS

Written Opinion of the International Searching Authority for International Application No. PCT/US2015/032839, dated Oct. 15, 2015.
Espace.net, English translation of RU55256, dated Feb. 11, 2016.
Espace.net, English translation of abstract of SU1369661, dated Feb. 11, 2016.

* cited by examiner

PROTECTIVE GLOVE WITH ENHANCED EXTERIOR SECTIONS

CROSS REFERENCE TO RELATED APPLICATIONS

This application is a continuation-in-part of U.S. patent application Ser. No. 14/210,533, filed Mar. 14, 2014 and incorporated herein, which claims priority to U.S. Provisional Patent Application No. 61/789,990, filed Mar. 15, 2013, which is also incorporated herein.

TECHNICAL FIELD AND BACKGROUND OF THE INVENTION

The present invention relates to fabric articles, such as gloves with sections having enhanced properties formed on the exterior surface of the glove. The enhanced sections can be areas on the exterior surface of the glove having superior physical properties, such as cut or abrasion resistance, in relation to the other parts of the glove.

Often it is desirable for a single glove to be constructed of various sections having distinct properties. For example, safety gloves often have an interior surface layer comprised of a relatively soft yarn for the comfort of the wearer, and an exterior surface comprised of a relatively rough yarn providing cut resistance. Plaiting (also known as "plating") is a process that has been used to make such gloves. Plaiting is a process in which the fabric is produced from two yarns having different properties or characteristics. A primary yarn is placed on the outside (or face) of the fabric, and the plaiting yarn is placed on the inside (or back) of the fabric.

Prior art gloves constructed of plaited fabrics have required the yarn with enhanced properties to be plaited to the inside (back) of the fabric. When it is desirable because of cosmetic or functional requirements for the plaiting yarn to be on the outside of the glove, the glove must be inverted (turned inside out). Inverting is a separate, time-consuming operation done manually or on a special machine.

SUMMARY OF THE INVENTION

Therefore, one object of the present invention is to provide a glove comprised of a plaited fabric, in which the plaiting yarn is plaited to the exterior surface of the fabric. Another object of the present invention is to provide a fabric article, such as a glove with sections having enhanced properties plaited to the exterior surface of the glove. The enhanced sections can be areas on the exterior surface of the glove having superior physical properties, such as cut or abrasion resistance, in relation to the other parts of the glove. These and other objects of the invention can be obtained in the preferred embodiments of the invention described below.

One embodiment of the invention comprises a protective glove comprising a primary yarn used to construct a palm section, and thumb, index finger, middle finger, ring finger and baby finger sections. The interior surface of the primary yarn defines the interior surface of the glove, and the exterior surface of the primary yarn defines the exterior surface of the glove. Enhanced sections are formed on the exterior surface of the glove, and the enhanced sections have at least one substantially enhanced physical characteristic in relation to the primary yarn.

According to another embodiment of the invention, the enhanced sections are formed by a secondary yarn plaited to portions of the exterior surface of the primary yarn.

According to another embodiment of the invention, the enhanced sections provide enhanced cut resistance, and the secondary yarn comprises at least one material selected from the group consisting of ultra-high molecular weight polyethylene and a hard particle-filled polyethylene fiber wherein the hard particles have a MOHS hardness of greater than three.

According to another embodiment of the invention, the enhanced sections are formed on portions of the index finger section, the middle finger section, the ring finger section and the baby finger section.

According to another embodiment of the invention, the enhanced sections are formed on the palm section, the thumb section, the index finger section, and the middle finger section.

According to another embodiment of the invention, the primary yarn comprises a core comprising a first strand of fiberglass and a second strand of ultra-high molecular weight polyethylene, and at least one cover strand wrapped around the core.

According to another embodiment of the invention, a first cover strand of textured polyester is wrapped around the core, and a second cover strand of textured polyester is wrapped around the core and the first strand of textured polyester.

According to another embodiment of the invention, the enhanced sections provide enhanced resistance to abrasion, and the secondary yarn comprises a strand of flat nylon.

According to another embodiment of the invention, the primary yarn comprises a core comprised of a first strand of fiberglass and a second strand of ultra-high molecular weight polyethylene, and at least one cover strand comprising textured polyester wrapped around the core.

According to another embodiment of the invention, the enhanced sections provide enhanced gripping properties, and the secondary yarn is comprised of latex rubber, spandex, and/or micro-fiber polyester.

According to another embodiment of the invention, the primary yarn comprises a core comprising a first core strand comprised of fiberglass and/or flat polyester, and a second core strand comprised of ultra-high molecular weight polyethylene and/or stainless steel wire.

According to another embodiment of the invention, a first cover strand comprised of textured polyester and/or stainless steel wire is wrapped around the core, and a second cover strand comprised of textured polyester is wrapped around the first cover strand and the core.

According to another embodiment of the invention, the enhanced sections are substantially rectangular and extend laterally across the palm section, the thumb section, and the finger sections of the glove.

According to another embodiment of the invention, the secondary yarn comprises a retroreflective material, so that the enhanced sections provide enhanced visibility of the glove.

According to another embodiment of the invention, the primary yarn comprises a core comprising a first strand of fiberglass and a second strand of ultra-high molecular weight polyethylene, and at least one cover strand comprising textured polyester wrapped around the core.

According to another embodiment of the invention, the secondary yarn comprises an electrically conductive material, so that a wearer of the glove can operate a touch screen on an electronic device by contacting the touch screen with the enhanced sections.

According to another embodiment of the invention, the primary yarn comprises a core comprising a first core strand comprising fiberglass, and a second core strand comprising ultra-high molecular weight polyethylene. A first cover strand comprising textured nylon is wrapped around the core, and a second cover strand comprising textured nylon is wrapped around the first cover strand and the core.

According to another embodiment of the invention, the enhanced sections are located at the tips of the thumb section, index finger section and middle finger section.

A protective glove according to another embodiment of the invention comprises a primary yarn defining a palm section, thumb section, index finger section, middle finger section, ring finger section and baby finger section. The interior surface of the primary yarn defines the interior surface of the glove, and the exterior surface defines the exterior surface of the glove. A first plaiting yarn is plaited to portions of the exterior surface of the primary yarn, and a second plaiting yarn is plaited to the first plaiting yarn to form a plurality of enhanced sections formed on the exterior surface of the glove. The enhanced sections having at least one substantially enhanced physical characteristic in relation to the primary yarn.

According to another embodiment of the invention, the first plaiting yarn comprises a core strand of spandex, a first cover strand of polyester wrapped around the core strand, and a second strand of nylon wrapped around the first cover strand and the core strand.

DESCRIPTION OF PREFERRED EMBODIMENTS OF THE INVENTION AND BEST MODE

Figure 1:
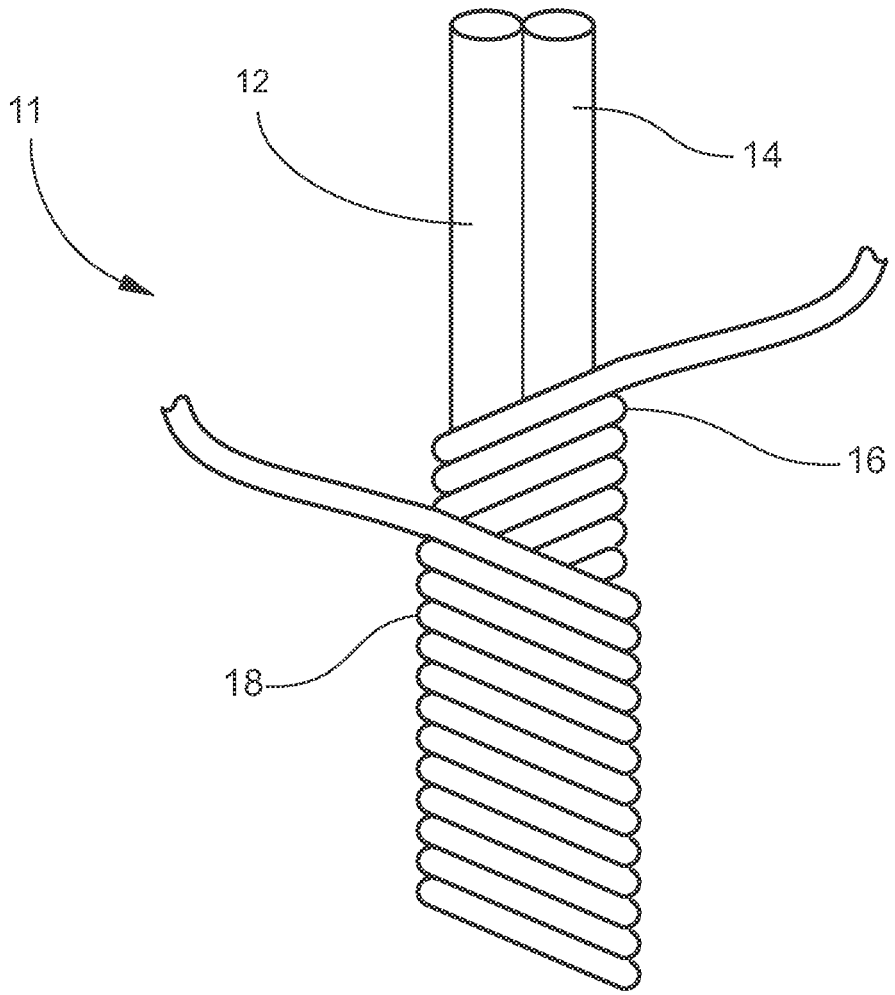
FIG. 1 is a schematic view of a yarn according to a preferred embodiment of the invention.

A protective glove according to a preferred embodiment of the invention is illustrated in FIGS. 1-6, and shown generally at reference numeral 10. The glove 10 is comprised of an inner primary yarn 11, and a plaiting yarn 21 having cut resistance properties plaited to the primary yarn 11. The inner primary yarn 11 can be comprised of a first core strand 12 of 450 (one hundred denier) fiberglass and a second core strand 14 comprised of four hundred denier ultra-high molecular weight polyethylene (UHMWPE), a first covering strand 16 of one-hundred fifty denier textured polyester wrapped around the core stands 12, 14, and a second covering strand 18 of one-hundred fifty denier textured polyester wrapped over the first cover strand 16, as shown in FIG. 1. As shown in FIG. 1, the first cover strand 16 is wrapped in an S orientation, while the second cover strand 18 is wrapped in a Z orientation. Alternatively, the first cover strand 16 can be wrapped in a Z orientation, and the second cover strand 18 can be wrapped in an S orientation.

Figure 5:
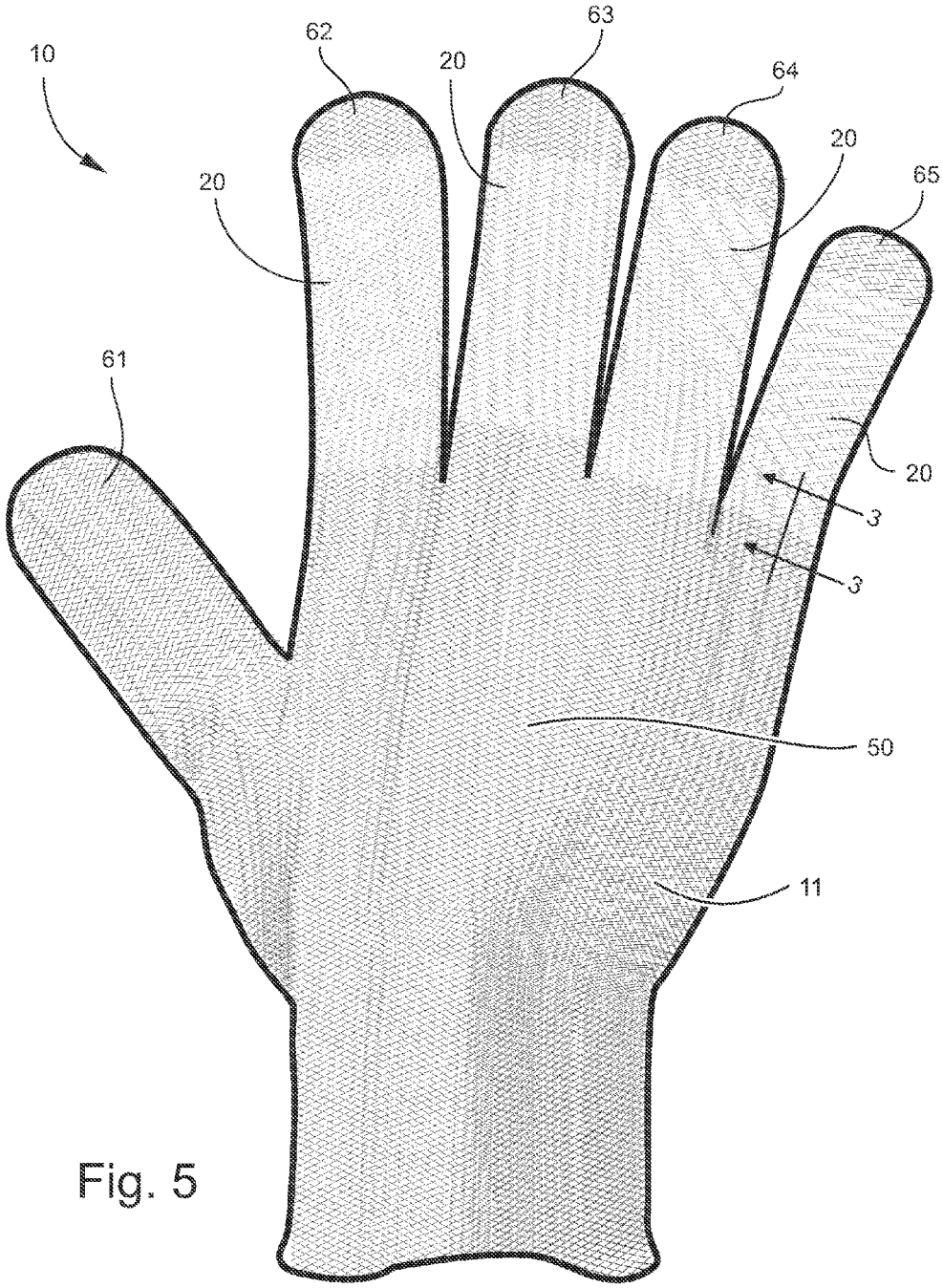
FIG. 5 is a schematic view of a protective glove according to a preferred embodiment of the invention.
Figure 6:
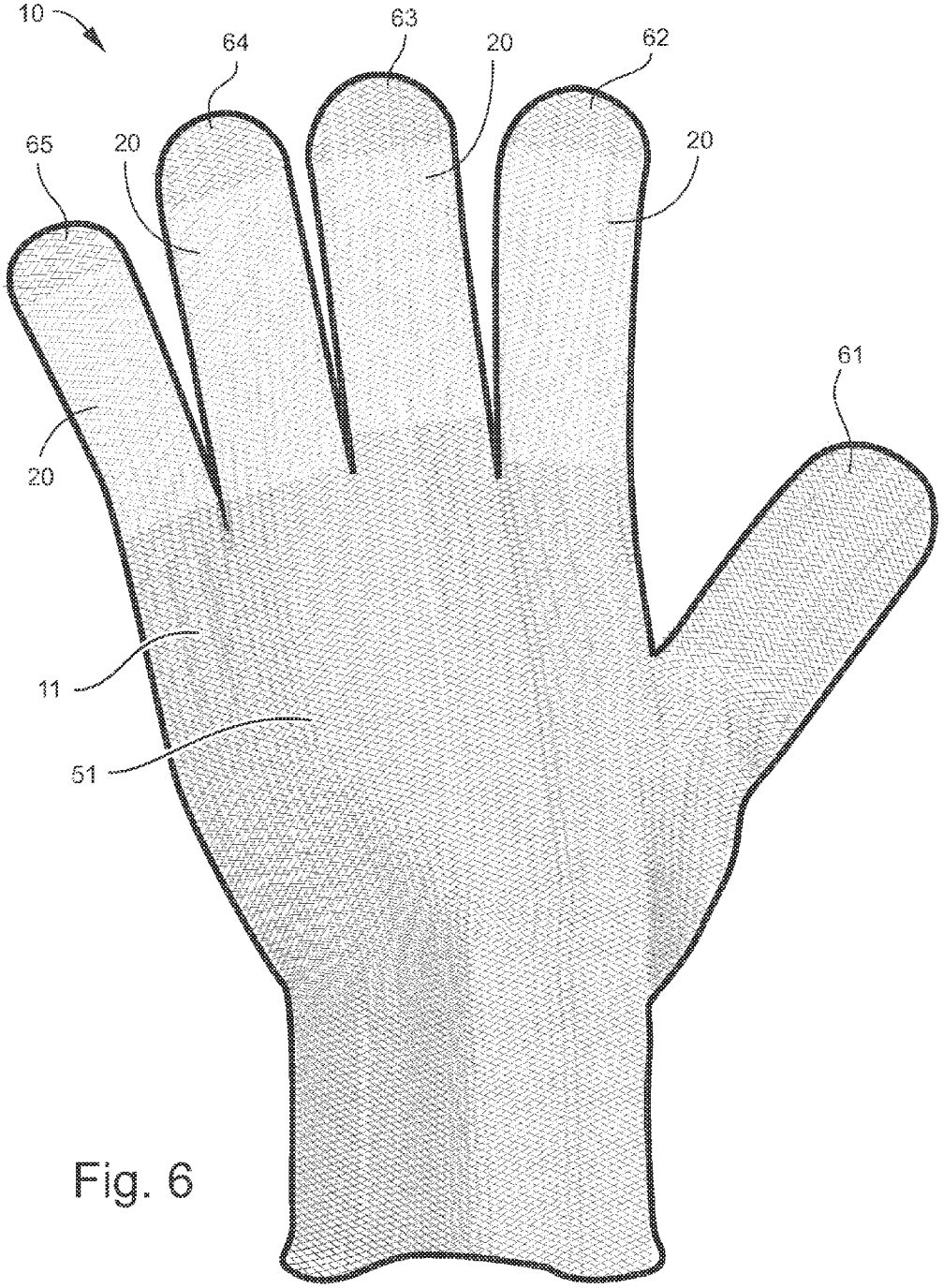
FIG. 6 is another schematic view of the protective glove of FIG. 5.

As shown in FIGS. 5 and 6, the glove 10 is generally comprised of a first palm section 50, a second palm section 51 on the opposite side of the first palm section 50, a thumb section 61, an index finger section 62, a middle finger section 63, a ring finger section 64 and a baby finger section 65, which are formed from the inner primary layer 11.

Figure 2:
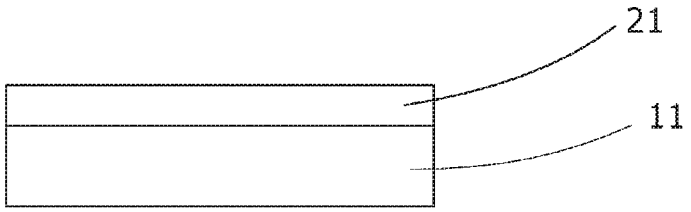
FIG. 2 is a magnified schematic view of a plaiting yarn plaited to a primary yarn according to a preferred embodiment of the invention.
Figure 7:
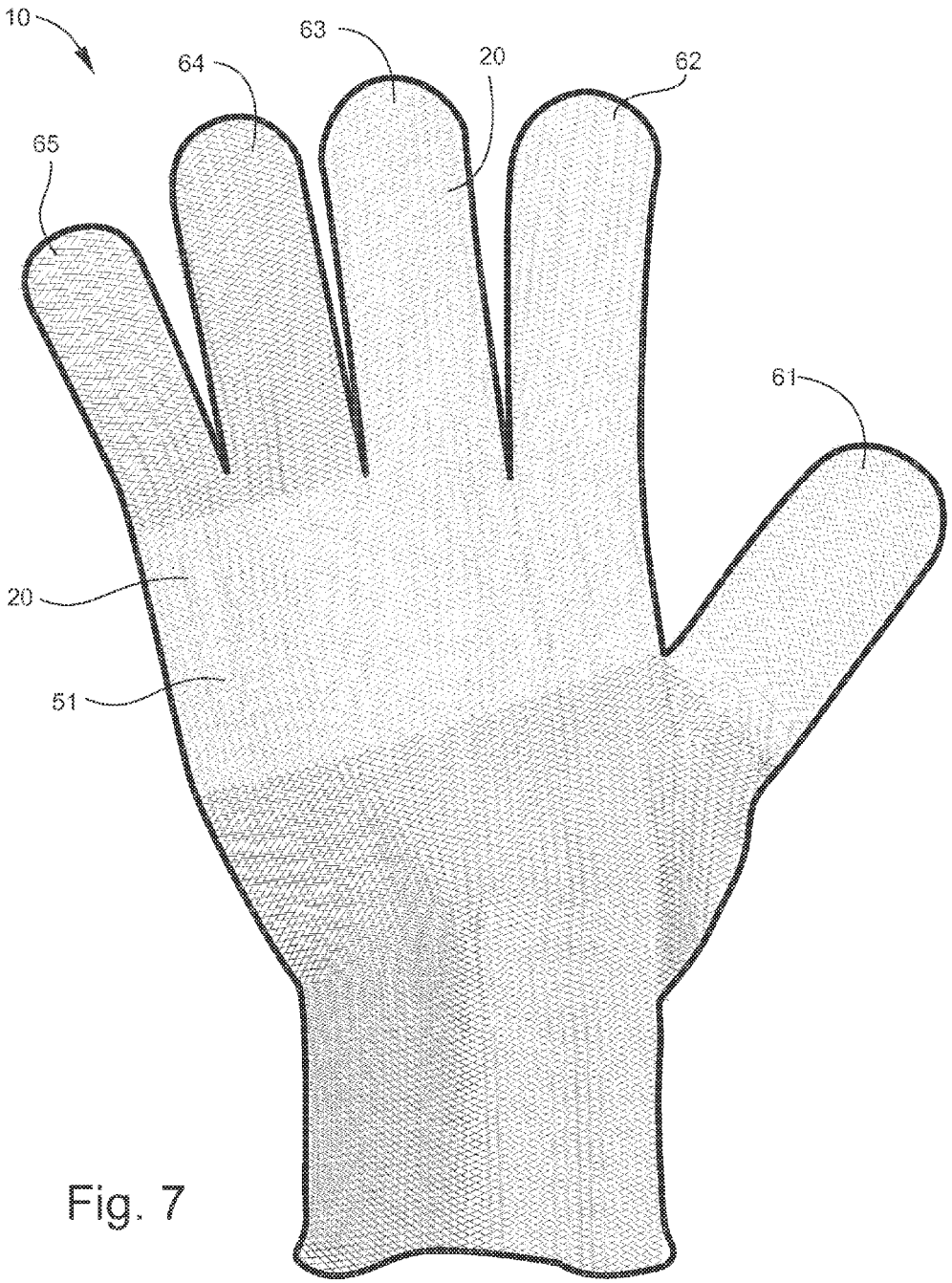
FIG. 7 is a schematic view of a protective glove according to another preferred embodiment of the invention.
Figure 8:
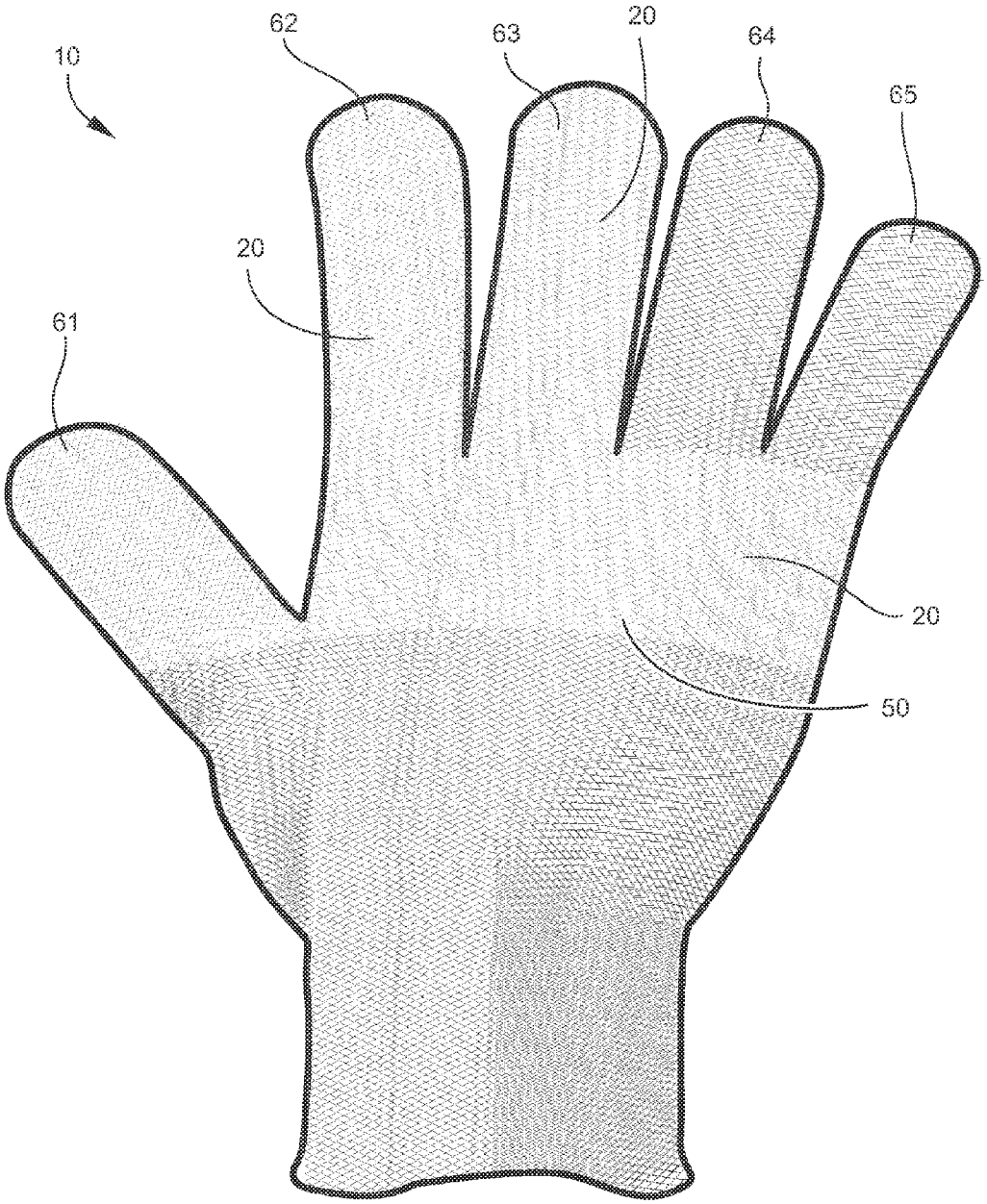
FIG. 8 is another schematic view of the protective glove of FIG. 7.

A plaiting yarn 21 comprising a strand of four hundred denier UHMWPE is plaited to the primary yarn 11, as shown in FIG. 2. The plaiting yarn 21 can be plaited at specific areas on the exterior surface of the inner primary layer 11 to form enhanced cut protection sections 20 on areas of the exterior of the glove 10 that are typically exposed to the greatest cutting hazard. As shown in FIGS. 5 and 6, the enhanced cut protection sections 20 can be formed on the index finger section 62, middle finger section 63, ring finger section 64 and baby finger section 65, except for at the finger tips. The enhanced sections 20 are formed on both sides of the glove 10 so that the glove is ambidextrous and can be worn on both the right and left hand. Alternatively, the enhanced sections 20 can be formed on the palm sections 50, 51, the thumb section 61, the index finger section 62, and the middle finger section 63, as shown in FIGS. 7 and 8. This configuration is particularly suitable for cut resistant gloves to be used in high hazard areas. By placing the enhanced sections 20 only at specific areas on the glove 10 where they are most needed, rather than plaiting the entire glove 10 with the plaiting yarn 21, the glove 10 can be made lighter in weight and more flexible.

The plaiting yarn 21 can be plaited to selected regions of the exterior surface of the primary yarn 11 using a conventional glove knitting machine modified to plate on the outside surface of the fabric in specified glove regions. By plaiting the plating yarn 21 directly to the exterior surface of the glove 10, it is not necessary to invert the glove 10 to have the plaiting yarn 21 on the outside of the glove, thereby eliminating this time consuming step from the manufacturing process.

Figure 3:
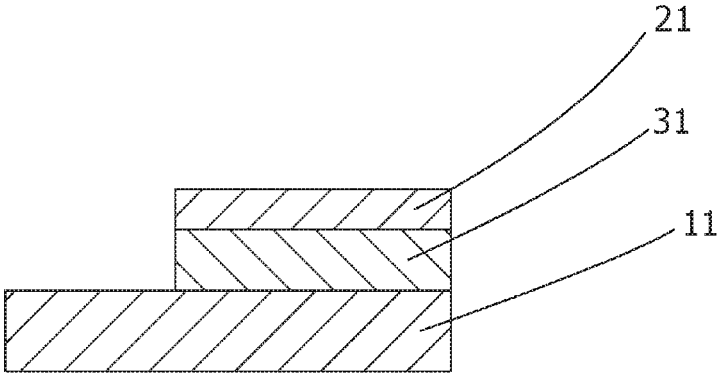
FIG. 3 is a magnified schematic view of a three layer fabric construction according to another preferred embodiment of the invention.
Figure 4:
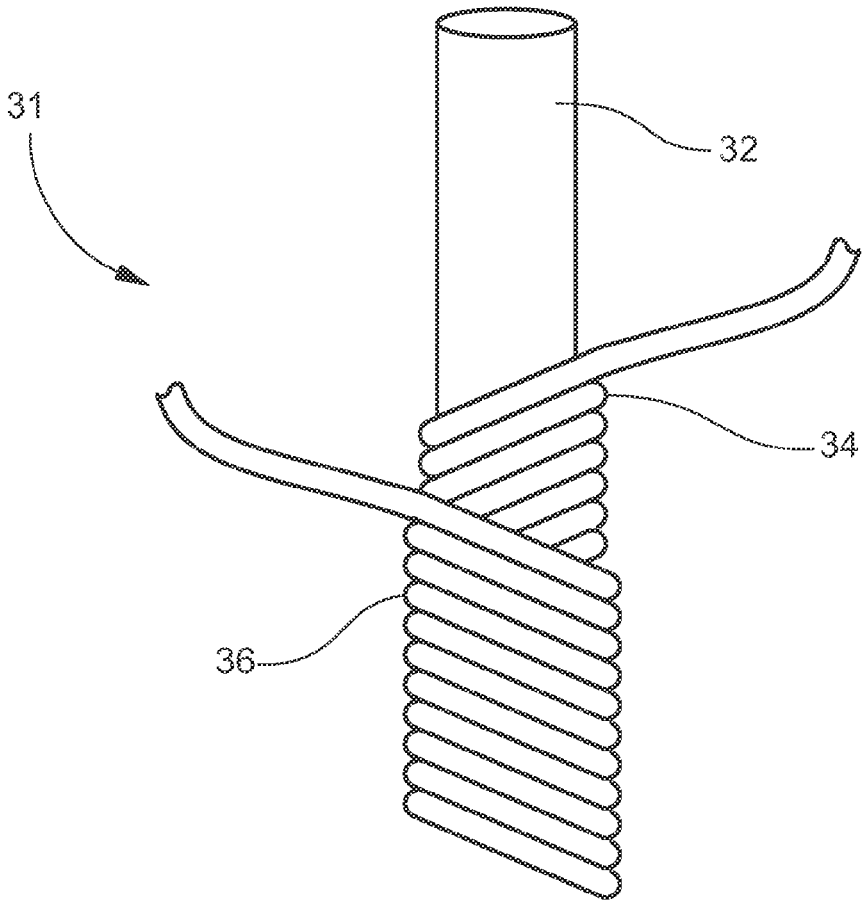
FIG. 4 is a schematic view of an intermediate plaiting yarn according to a preferred embodiment of the invention.

Alternatively, the protective glove 10 can be knit in three layers, utilizing two plaiting yarns 21, 31. As shown in FIG. 3, an intermediate plaiting yarn 31 comprised of spandex can be plaited to the inner primary yarn 11. The outer plaiting yarn 21, comprised of four hundred denier UHMWPE, is plaited to the intermediate plaiting yarn 31, as shown in FIG. 3. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 4. The intermediate plaiting yarn 31 provides a softer, more elastic and form fitting feel of the glove 10. Alternatively, the intermediate plaiting yarn 31 can comprise a moisture wicking yarn, such as HYDROTECH, or a treated fiber such as STA-COOL or SORBTEK.

In an alternative embodiment, the inner primary yarn 11 first core strand 12 can be one hundred denier basalt fiber, the second core strand 14 can be two hundred denier UHMWPE, the first covering strand 16 can be seventy denier textured polyester and the second covering strand 18 can be seventy denier textured polyester. The plaiting yarn 21 can be a strand of four hundred denier hard particle-filled polyethylene fiber, in which the hard particles are polymeric or mineral particles having a MOHS hardness of greater than three.

In another alternative embodiment, the primary yarn 11 first core strand 12 can be D450 fiberglass, the second core strand 14 can be two hundred denier UHMWPE, the first covering strand 14 can be seventy denier textured polyester, and the second covering strand can be seventy denier polyester. The plaiting yarn 21 can comprise a two hundred denier hard particle-filled polyethylene fiber, in which the hard particles are polymeric or mineral particles having a MOHS hardness of greater than three.

In another alternative embodiment, two ends of the primary yarn 11 can be knit together through the same yarn feeder, and the plaiting yarn 21 is plaited to thereto. The plaiting yarn 21 can comprise a strand of 20/1 aramid fiber, such as DuPont KEVLAR or Teijin TWARON, a strand of 0.0016 stainless steel , and a covering strand of 20/1 polyester wrapped around the aramid fiber and stainless steel.

In another preferred embodiment of the invention, the protective glove 10 has enhanced sections 20 having enhanced resistance to abrasion. In this embodiment, the glove 10 has an inner primary yarn 11 comprised of a first core strand 12 of D450 fiberglass, a second core strand 14 of two hundred denier UHMWPE, a first covering yarn 16 of seventy denier textured polyester, and a second covering yarn 18 of seventy denier textured polyester. The plaiting yarn 21 comprises a strand of two hundred twenty denier flat nylon, as shown in FIG. 3.

The plaiting yarn 21 can be plaited at specific areas on the inner primary layer 11 to form enhanced abrasion resistance sections 20 on the exterior of the glove 10, as shown in FIGS. 5 and 6. As shown in FIGS. 5 and 6, the enhanced abrasion resistance sections 20 can be formed on the index finger section 62, middle finger section 63, ring finger section 64 and baby finger section 65, except for at the finger tips. The enhanced abrasion resistance sections 20 are formed on both sides of the glove 10 so that the glove is ambidextrous and can be worn on both the right and left hand.

Alternatively, the glove 10 having enhanced abrasion resistance sections 20 can be knit in three layers, utilizing two plaiting yarns 21, 31. As shown in FIG. 3, an intermediate plaiting yarn 31 comprised of spandex can be plaited to the inner primary yarn 11. The outer plaiting yarn 21, comprised of two hundred twenty denier flat nylon, is plaited to the intermediate plaiting yarn 31. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 4. Alternatively, the intermediate plaiting yarn 31 can comprise a moisture wicking yarn, such as HYDROTECH, or a treated fiber such as STAYCOOL or SORBTEK.

In an alternative embodiment, the primary yarn 11 can be comprised of a first core strand 12 of one hundred fifty denier basalt fiber, a second core strand 14 of UHMWPE, with a first covering yarn of 70 denier textured polyester and a second covering yarn of 70 denier textured polyester. The plaiting yarn consists of a 20/1 polyester treated with PTFE.

In another alternative embodiment, the primary yarn 11 comprises a first core strand 12 of two hundred twenty denier flat polyester, a second core strand 14 of 0.002 stainless steel wire, a first covering strand 16 of 0.002 stainless steel wire, and a second covering strand of 3/150 denier textured polyester. The plaiting yarn 21 comprises two hundred twenty denier flat nylon.

According to another preferred embodiment of the invention, the protective glove 10 has enhanced sections 20 having improved gripping properties. The inner primary yarn 11 of this embodiment can be comprised of a first core strand 12 of D450 fiberglass, a second core strand 14 comprised of two hundred denier UHMWPE, a first covering yarn 16 comprised of seventy denier textured polyester, and a second covering yarn comprised of seventy denier textured polyester. The plaiting yarn 21 comprises a strand of fifty gauge latex rubber.

Figure 9:
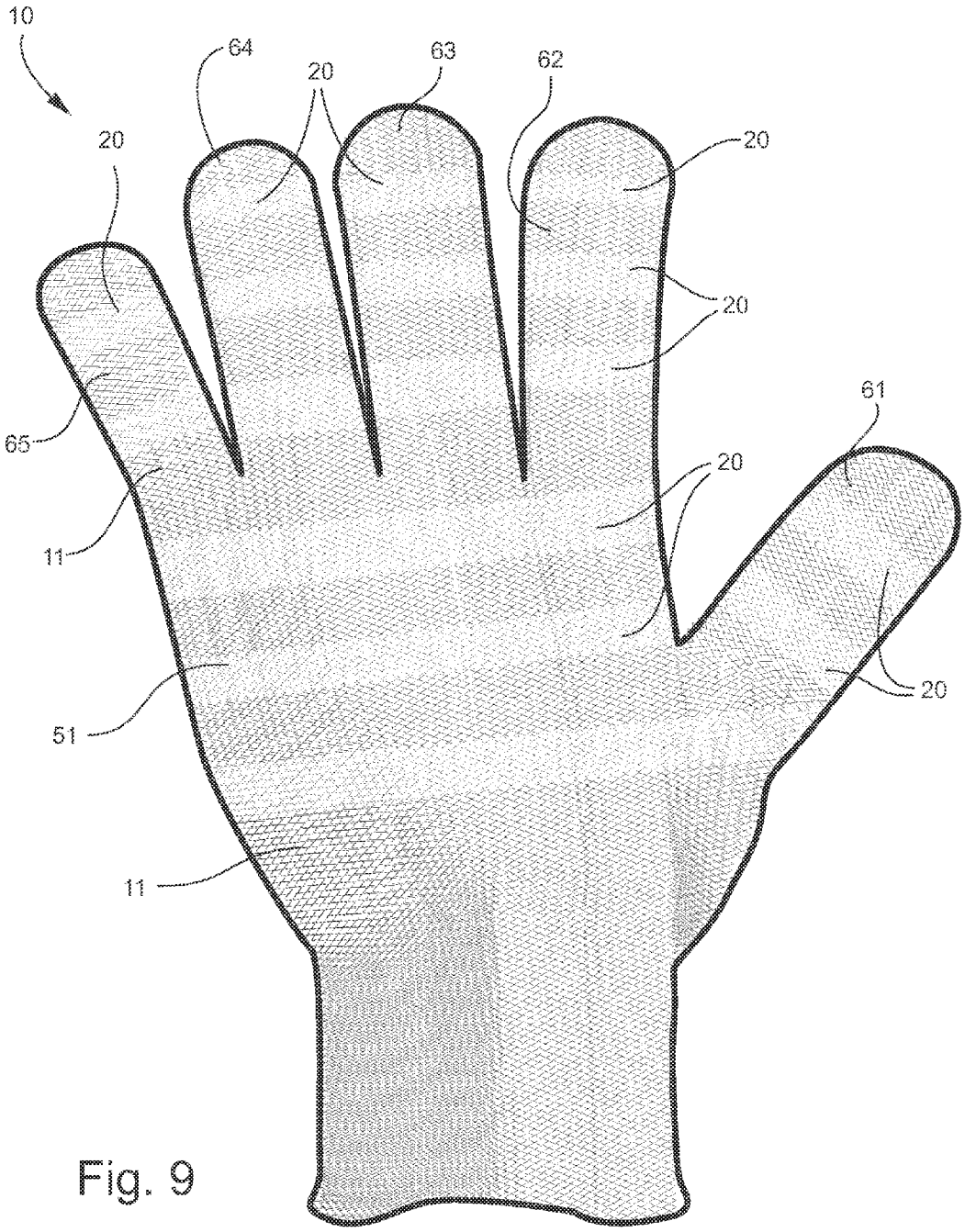
FIG. 9 is a schematic view of a protective glove according to another preferred embodiment of the invention.

The plaiting yarn 21 is plaited at specific areas on the inner primary layer 11 to form enhanced gripping sections 20 on the exterior of the glove 10. The enhanced sections 20 can be substantially rectangular sections extending laterally across the palm sections 50, 51, the thumb section 61, and the finger sections 62-65, as shown in FIG. 9. The enhanced gripping sections 20 are formed on both sides of the glove 10 so that the glove is ambidextrous and can be worn on both the right and left hand.

Alternatively, the glove 10 having enhanced gripping sections 20 can be knit in three layers, utilizing two plaiting yarns 21, 31. As shown in FIG. 3, an intermediate plaiting yarn 31 comprised of spandex can be plaited to the inner primary yarn 11. The outer plaiting yarn 21, comprised of fifty gauge latex rubber, is plaited to the intermediate plaiting yarn 31. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 4. Alternatively, the intermediate plaiting yarn 31 can comprise a moisture wicking yarn, such as HYDROTECH, or a treated fiber such as STAYCOOL or SORBTEK.

In an alternative embodiment, the primary yarn 11 is comprised of a first core strand 12 of two hundred twenty denier flat polyester, a second core strand 14 of 0.002 stainless steel wire, a first covering strand 16 of 0.002 stainless steel, and a second covering strand 18 of two hundred twenty denier textured polyester. The plaiting yarn 21 is comprised of a strand of four hundred twenty denier spandex.

In another alternative embodiment, the primary yarn 11 comprises a first core strand 12 of D225 fiberglass, a second core strand 14 of four hundred denier UHMWPE, a first covering strand 16 of one hundred fifty denier textured polyester, and a second covering strand 18 of fifty denier textured polyester. The plaiting yarn 21 is comprised of a strand of one hundred fifty denier micro-fiber polyester.

According to another preferred embodiment of the invention, the glove 10 can have enhanced exterior sections 20 that provide enhanced visibility of the glove 10. The protective glove 10 with enhanced visibility has an inner primary yarn 11 comprised of a first core strand of D450 fiberglass, a second core strand 14 of two hundred twenty denier UHMWPE, a first covering strand 16 comprised of 70 denier textured polyester, and a second covering strand comprised of 70 denier textured polyester. The plaiting yarn 21 comprises a retroreflective material such as the 2P2 Retroglo slit film sold by Metlon Corp.

Figure 10:
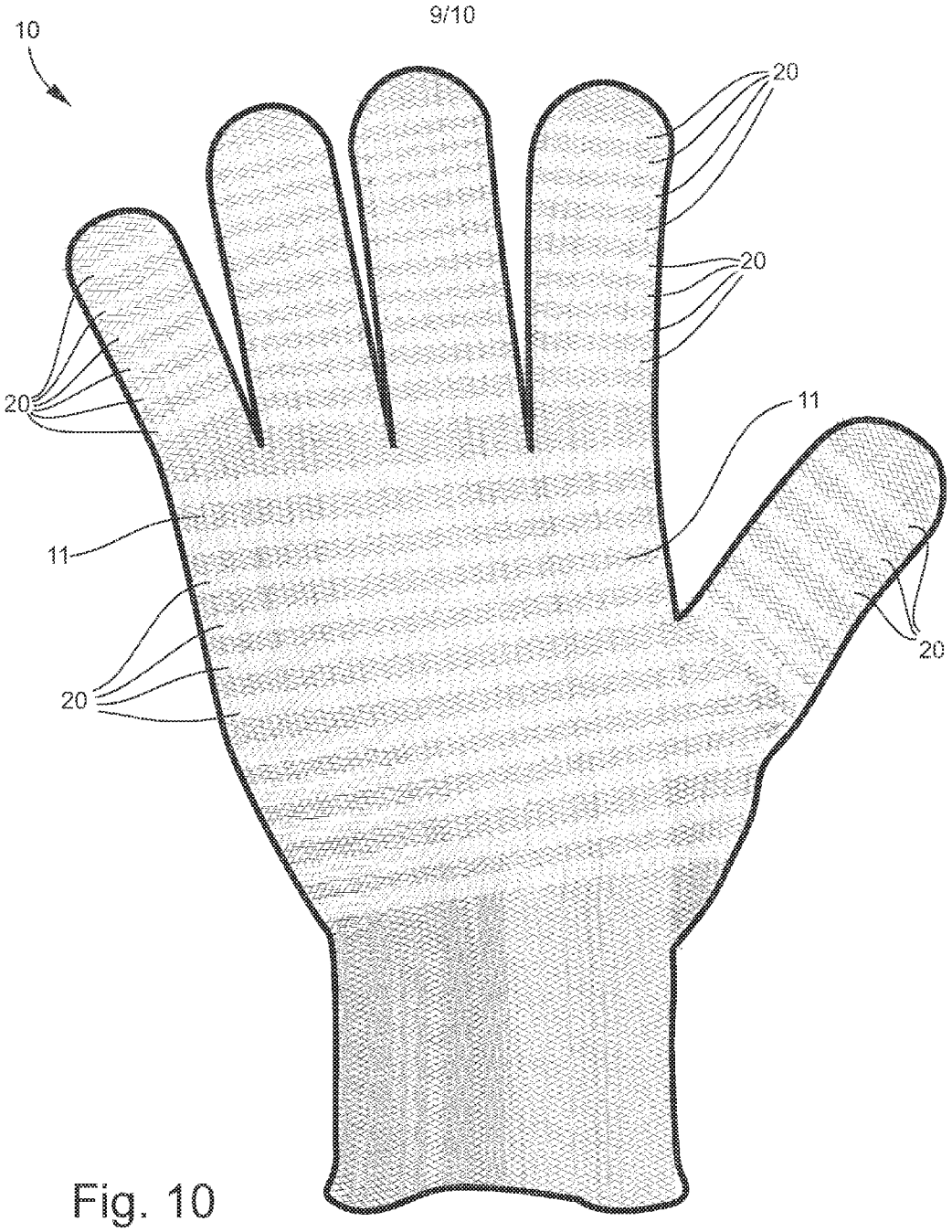
FIG. 10 is a schematic view of a protective glove according to another preferred embodiment of the invention.

The plaiting yarn 21 is plaited at specific areas on the inner primary layer 11 to form enhanced visibility sections 20 on the exterior of the glove 10. The enhanced visibility resistance sections 20 can be substantially rectangular sections extending across the palm sections 50, 51, the thumb section 61, and the finger sections 62-65, as shown in FIG. 10. The enhanced visibility sections 20 are formed on both sides of the glove 10 so that the glove is ambidextrous and can be worn on both the right and left hand.

Alternatively, the glove 10 having enhanced visibility sections 20 can be knit in three layers, utilizing two plaiting yarns 21, 31. As shown in FIG. 5, an intermediate plaiting yarn 31 comprised of spandex can be plaited to the inner primary yarn 11. The outer plaiting yarn 21, comprised of a retro-reflective material, is plaited to the intermediate plaiting yarn 31. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 6. Alternatively, the intermediate plaiting yarn 31 can comprise a moisture wicking yarn, such as HYDROTECH, or a treated fiber such as STAYCOOL or SORBTEK.

According to another preferred embodiment of the invention, the glove 10 can have enhanced exterior sections 20 that are adapted for use on electronic touch screen devices. In this embodiment, the enhanced exterior sections 20 comprise electrically conductive materials enabling the wearer to operate a touch screen on an electronic device while wearing the glove 10 by contacting the touch screen with the enhanced sections 20. As such, the wearer may keep the glove 10 on his hand and use the touch screen device without having to remove the glove 10. This embodiment is particularly useful for those wearing cut resistant gloves in the workplace who need to manipulate electronic touch-screen devices for inventory, order processing communication and the like. The inner primary inner primary yarn 11 of this embodiment can be comprised of a first core strand 12 of D450 fiberglass, a second core strand 14 of two hundred twenty denier UHMWPE, a first covering strand 16 of seventy denier textured nylon, and a second covering strand 18 of seventy denier textured nylon. The plaiting yarn 21 can be comprised of a one hundred denier silver-coated electrically conductive yarn such as X-STATIC fiber sold by Noble Technologies.

Figure 11:
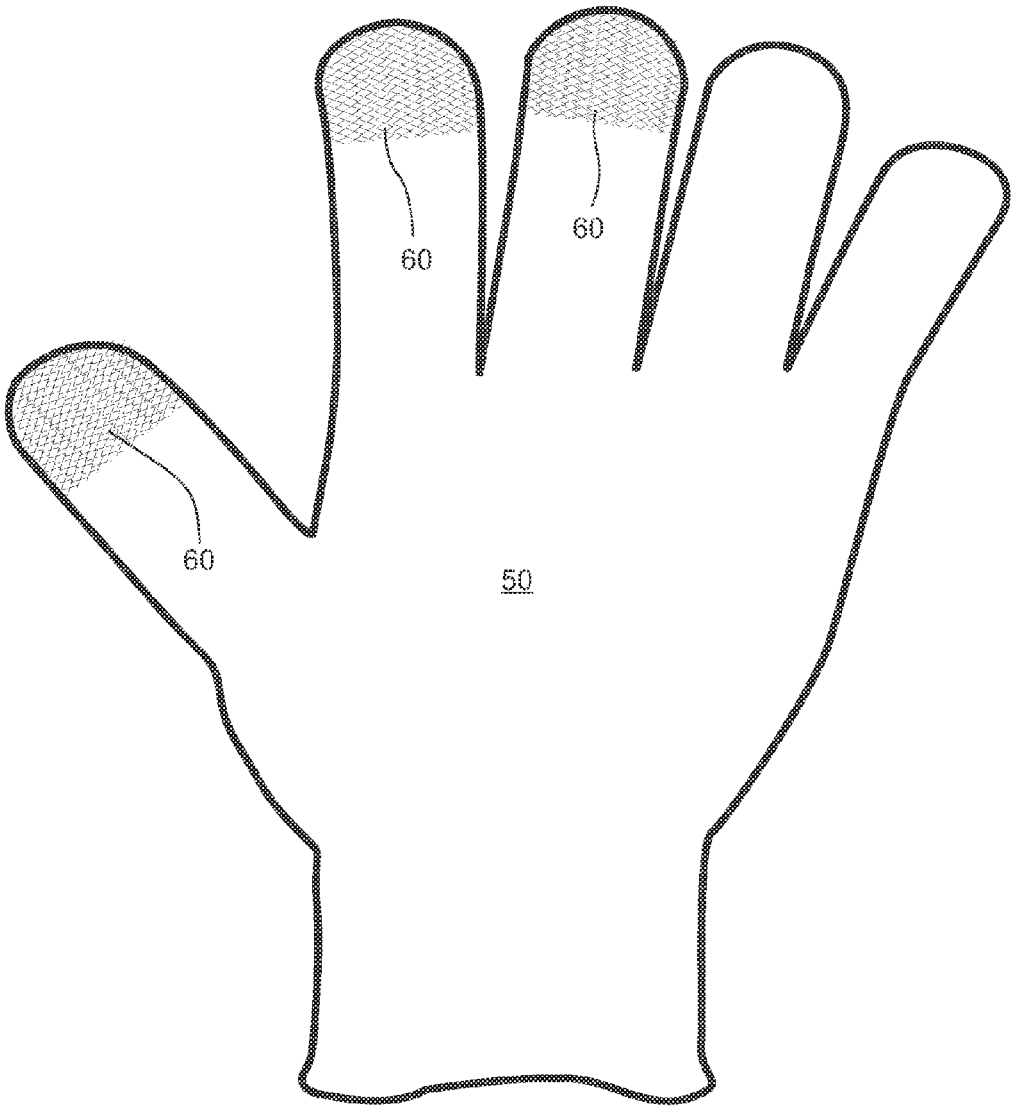
FIG. 11 is a schematic view of a protective glove according to another preferred embodiment of the invention.

The plaiting yarn 21 is plaited at specific areas on the inner primary layer 11 to form enhanced touch screen compatible sections 20 on the exterior of the glove 10. The enhanced touch screen compatible sections 20 can be located at the tips (distal phalanges) of the thumb 61, index finger 62 and middle finger 63, as shown in FIG. 11. The touch screen compatible sections 20 are formed on both sides of the thumb 61, index finger 62 and middle finger 63 so that the glove is ambidextrous and can be worn on either the right or left hand.

Alternatively, the glove 10 having touch screen compatible sections 20 can be knit in three layers, utilizing two plaiting yarns 21, 31. As shown in FIG. 5, an intermediate plaiting yarn 31 comprised of spandex can be plaited to the inner primary yarn 11. The outer plaiting yarn 21, comprised of an electrically conductive material, is plaited to the intermediate plaiting yarn 31. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 6.

In an alternative embodiment, the primary yarn 11 can be comprised of a first core strand 12 of D225 fiberglass, a second core strand 14 of four hundred denier UHMWPE, a first covering strand 16 of one hundred fifty denier textured polyester, and a second covering strand 18 of one hundred fifty denier textured polyester. The plaiting yarn 21 can be comprised of a seventy denier electrically conductive copper-suffused nylon, such as THUNDERON fiber sold by Nihon Sanmo Dyeing Co.

Protective gloves and methods of making same are described above. Various changes can be made to the invention without departing from its scope. The above description of embodiments and best mode of the invention are provided for the purpose of illustration only and not limitation—the invention being defined by the claims and equivalents thereof.

What is claimed is:

1. A protective glove comprising:

(a) a primary yarn defining a palm section, thumb section, index finger section, middle finger section, ring finger section and baby finger section, the primary yarn having an interior surface defining an interior surface of the glove and an exterior surface defining an exterior surface of the glove, wherein the primary yarn comprises (i) a core comprising a first strand of fiberglass and a second strand of ultra-high molecular weight polyethylene, and (ii) at least one cover strand wrapped around the core; and (b) a first plaiting yarn plaited to portions of the exterior surface of the primary yarn and a second plaiting yarn plaited to the first plaiting yarn to form a plurality of enhanced sections formed on the exterior surface of the glove, the plurality of enhanced sections having at least one enhanced physical characteristic in relation to the primary yarn.

2. The protective glove according to claim 1, wherein the enhanced sections are formed on the palm section, the thumb section, the index finger section, and the middle finger section.

3. The protective glove according to claim 1, wherein the at least one cover strand comprises a first strand of textured polyester wrapped around the core, and a second strand of textured polyester wrapped around the core and the first strand of textured polyester.

4. The protective glove according to claim 1, wherein the first plaiting yarn comprises:

(a) a core strand of spandex;

(b) a first cover strand of polyester wrapped around the core strand; and (c) a second cover strand of nylon wrapped around the first cover strand and the core strand.

5. The protective glove according to claim 4, wherein the second plaiting yarn comprises a strand of flat nylon.

6. A protective glove comprising:

(a) a primary yarn defining a palm section, thumb section, index finger section, middle finger section, ring finger section and baby finger section, the primary yarn having an interior surface defining an interior surface of the glove and an exterior surface defining an exterior surface of the glove; and (b) a first plaiting yarn plaited to portions of the exterior surface of the primary yarn and a second plaiting yarn plaited to the first plaiting yarn to form a plurality of enhanced sections formed on the exterior surface of the glove, the plurality of enhanced sections having at least one enhanced physical characteristic in relation to the primary yarn, wherein the first plaiting yarn comprises:

(i) a core strand of spandex, (ii) a first cover strand of polyester wrapped around the core strand, and (iii) a second cover strand of nylon wrapped around the first cover strand and the core strand.

* * * * *